US006529089B2

(12) United States Patent
Yuanzhu

(10) Patent No.: US 6,529,089 B2
(45) Date of Patent: Mar. 4, 2003

(54) CIRCULARLY POLARIZED WAVE GENERATOR USING A DIELECTRIC PLATE AS A 90° PHASE SHIFTER

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/960,686

(22) Filed: Sep. 21, 2001

(65) Prior Publication Data

US 2002/0036548 A1 Mar. 28, 2002

(30) Foreign Application Priority Data

Sep. 27, 2000 (JP) ..... 2000-294674

(51) Int. Cl.[7] ..... H01P 1/16

(52) U.S. Cl. ..... 333/21 A; 333/137; 333/136; 343/786

(58) Field of Search ..... 333/134, 136, 333/122, 137, 21 A, 21 R, 135, 24.3, 26, 125; 343/786, 785, 756

(56) References Cited

U.S. PATENT DOCUMENTS 4,353,041 A * 10/1982 Bryans et al. ..... 333/21 A
4,806,945 A * 2/1989 Cormier et al. ..... 333/21 A
5,122,810 A * 6/1992 Nisbet et al. ..... 333/21 A
5,359,336 A * 10/1994 Yoshida ..... 333/21 A
5,760,658 A * 6/1998 Tokuda et al. ..... 333/21 A
5,852,390 A * 12/1998 Yoshimura ..... 333/21 A
6,452,559 B1 * 9/2002 Yuanzhu ..... 333/21 A

FOREIGN PATENT DOCUMENTS

JP 2001-44703 2/2001

* cited by examiner

*Primary Examiner*—Michael Tokar
*Assistant Examiner*—Lam T. Mai
(74) *Attorney, Agent, or Firm*—Brinks Hofer Gilson & Lione

(57) ABSTRACT

A dielectric plate is fixed inside a first waveguide, the inside of which is hollow, having a square opening at one end thereof, the dielectric plate is orthogonal to two parallel sides of the opening, a second waveguide having a square cross-section is connected to the other end of the first waveguide, and the dielectric plate is tilted by substantially 45° with respect to a pair of opposing internal wall surfaces of the second waveguide.

6 Claims, 5 Drawing Sheets

CIRCULARLY POLARIZED WAVE GENERATOR USING A DIELECTRIC PLATE AS A 90° PHASE SHIFTER

BACKGROUND OF THE INVENTION

1. Field of the Invention

The present invention relates to a circularly polarized wave generator used in transmitter-receivers for satellite broadcasting systems, etc., and particularly to a circularly polarized wave generator using a dielectric plate as a 90° phase shifter.

2. Description of the Related Art

FIGS. 9A and 9B show such a conventional circularly polarized wave generator, FIG. 9A is its left side view, and FIG. 9B is its sectional view. This conventional circularly polarized wave generator is provided with a waveguide 10 in which one end is open and the other end is closed and a dielectric plate 11 is arranged inside the waveguide 10, and a pair of probes 12 and 13 are inserted inside the waveguide 10 through its external wall surfaces. The waveguide 10 is a rectangular waveguide having a square cross-section the inside of which is hollow, and the feature of such a rectangular waveguide is that, as compared to a circular waveguide having a circular cross-section, for example, the area of a Printed Circuit board (not illustrated) to which the probes 12 and 13 are connected can be reduced. The dielectric plate 11 functions as a 90° phase shifter, and is composed of a dielectric material having a uniform thickness. The dielectric plate 11 is fixed at two corner portions located on a diagonal plane inside the waveguide 10, and both ends in the longitudinal direction of the dielectric plate 11 are cut to be V-shaped so that the input and output impedance matching is improved. The two probes 12 and 13 are orthogonal to each other and the dielectric plate 11 is tilted about 45 degrees with respect to the probes 12 and 13.

In the circularly polarized wave generator constructed in this way, a circularly polarized wave input into the waveguide 10 can be converted into a linearly polarized wave to output the linearly polarized wave, and, on the contrary, a linearly polarized wave input into the waveguide 10 can be converted into a circularly polarized wave to output the circularly polarized wave. That is, since a circularly polarized wave is a polarized wave in which a composite vector of two linearly polarized waves having the same amplitude and a 90-degree phase difference therebetween rotates, when the circularly polarized wave passes through the dielectric plate 11, the waves having a 90-degree phase difference from each other are made to have the same phase and are thus converted into a linearly polarized wave. In the example shown in FIGS. 9A and 9B, since a left-handed circularly polarized wave input to the waveguide 10 is converted into a vertically polarized wave and a right-handed circularly polarized wave is converted into a horizontally polarized wave, the vertically polarized wave and horizontally polarized wave are received by the probes 12 and 13, respectively, which are arranged to be orthogonal to the planes of polarization and the received signals can be frequency converted into intermediate-frequency signals by a converter circuit (not illustrated) to output the intermediate-frequency signals.

In the circularly polarized wave generator having the construction as described above, the electric field distribution inside the waveguide 10 having a square cross-section is as shown in FIG. 10. As clearly shown in the drawing, the electric field E1 (broken line) and the electric field E2 (solid line) are arc-shaped distributions of field strength centered on the corner portions of the waveguide 10, and it can be understood that the electric field E1 does not exist at both edge portions of the dielectric plate 11 which are fixed to the corner portions of the waveguide 10. This is because the electric fields E1 and E2 on each flat surface of the waveguide 10 are perpendicular to its surface in the nature of things, and, as a result, the polarized wave component propagating in the dielectric plate 11 decreases. For such a reason, it is required to sufficiently lengthen the dielectric plate 11 along the central axis of the waveguide 10 so that the waves having a 90° phase difference from each other may be made to have the same phase by the dielectric plate 11, and this fact has been a major obstacle to miniaturization of circularly polarized wave generators. Moreover, such a problem becomes obvious when waveguides having a square cross-section are used, but also the problem can be seen in the same way when waveguides having a circular cross-section are used.

SUMMARY OF THE INVENTION

The present invention has been made by considering such facts about the conventional technology, and it is an object of the present invention to provide a circularly polarized wave generator in which the length of a dielectric plate as a 90° phase shifter is reduced and which is appropriate for miniaturization.

In order to attain the above object, a circularly polarized wave generator of the present invention comprises a first waveguide having a square opening at one end thereof, a dielectric plate arranged inside the first waveguide so as to be substantially orthogonal to two parallel sides of the opening, and a second waveguide having a square cross-section coaxially connected to the other end of the first waveguide, and is characterized in that the dielectric plate is tilted substantially 45° with respect to the inner wall surfaces of the second waveguide.

In the circularly polarized wave generator constructed in this way, since the dielectric plate arranged inside the first waveguide is tilted substantially 45° toward the flat surfaces of the second waveguide and the dielectric plate is substantially orthogonal to the parallel two sides of the opening of the first waveguide, even if the length of the dielectric plate is shortened, a phase difference between orthogonal polarized waves becomes large and the circularly polarized wave generator can be made smaller. In this case, the opening of the first waveguide is preferably square, but also regular polygons such as a regular hexagon, a regular octagon, etc., in which opposing two sides are parallel to each other, can be used.

In order to attain the above object, a circularly polarized wave generator of the present invention comprises a first waveguide having a circular opening at one end thereof, a dielectric plate arranged inside the first waveguide, and a second waveguide having a square cross-section coaxially connected to the other end of the first waveguide, and is characterized in that the dielectric plate is tilted substantially 45° with respect to the inner wall surfaces of the second waveguide.

Also in the thus constructed circularly polarized wave generator, since the dielectric plate arranged inside the first waveguide is tilted substantially 45° toward the flat surfaces of the second waveguide, even if the length of the dielectric plate is shortened, a phase difference between orthogonal polarized waves becomes large and the circularly polarized wave generator can be made smaller.

In each of the constructions described above, the second waveguide is preferably inscribed in the opening of the first waveguide so that the corner portions of the neighboring inner wall surfaces of the second waveguide are on the boundary of the opening, and, when constructed in this way, a first waveguide and a second waveguide which are connected in the axial direction can be easily produced by rolling out and expanding part of a waveguide having a square cross-section.

DESCRIPTION OF THE PREFERRED EMBODIMENTS

Figure 1:
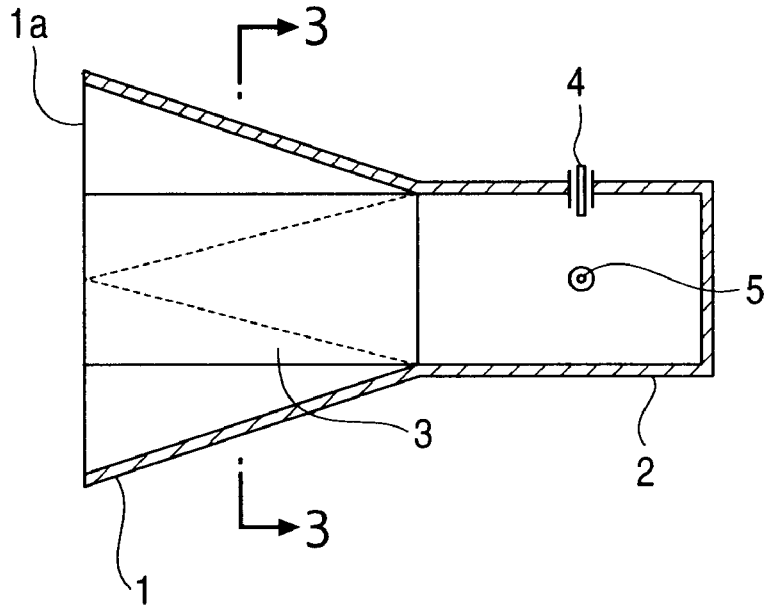
FIG. 1 shows the construction of a circularly polarized wave generator according to a first embodiment of the present invention.

Hereinafter, the embodiments of the present invention are described with reference to the drawings. FIG. 1 shows the construction of a circularly polarized wave generator according to a first embodiment of the present invention, FIG. 2 is a left side view of the circularly polarized wave generator, FIG. 3 is a sectional view taken on line 3—3 of FIG. 1, and FIG. 4 is a perspective view of the circularly polarized wave generator.

As shown in these drawings, the circularly polarized wave generator according to the present embodiment includes a first waveguide 1, the inside of which is hollow, having an opening 1*a* at one end thereof, a second waveguide 2 coaxially connected to the other end of the first waveguide, and a dielectric plate 3 provided inside the first waveguide 1. A pair of probes 4 and 5 are inserted inside the second waveguide 2 through its external wall surfaces, and these probes 4 and 5 are about one quarter wavelength away from the right closed surface of the second waveguide 2 shown in the drawing.

Figure 2:
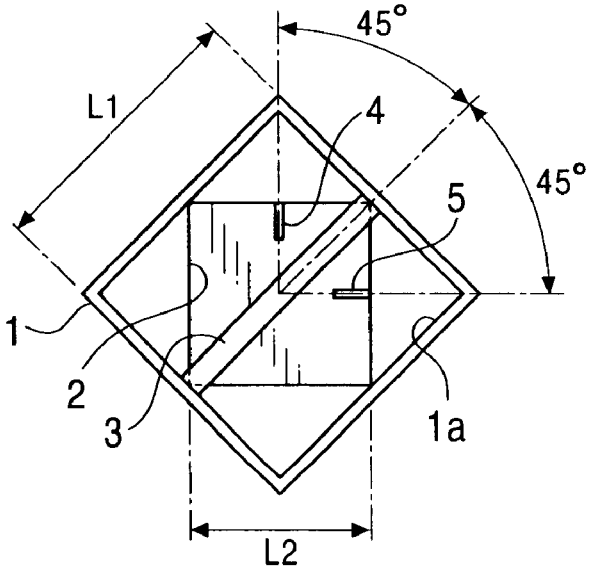
FIG. 2 is a left side view of the circularly polarized wave generator.
Figure 3:
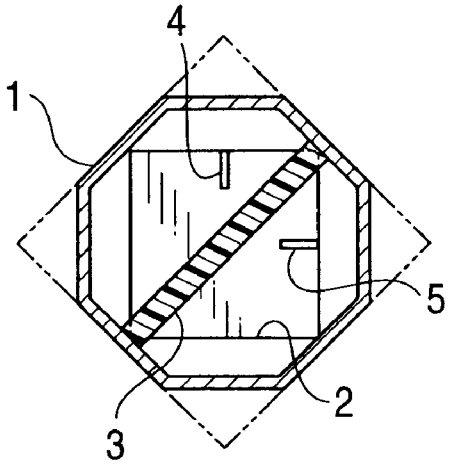
FIG. 3 is a sectional view taken on line 3—3 of FIG. 1.
Figure 4:
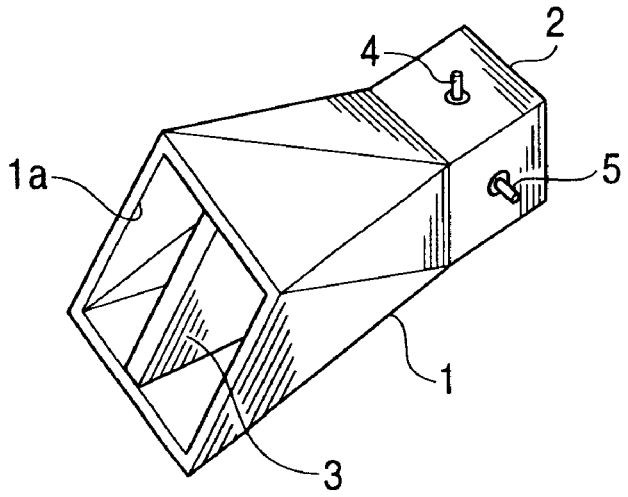
FIG. 4 is a perspective view of the circularly polarized wave generator.

As clearly seen in FIG. 2, the opening 1*a* at the left end of the first waveguide 1 shown in FIG. 1 is a regular square, but, as shown in FIG. 3, the shape of the cross-section in the middle of the first waveguide 1 is octagonal. On the other hand, the second waveguide 2 is made of a regular square waveguide having a hollow portion which is square in cross-section, and each side of the opening 1*a* of the first waveguide 1 is tilted at substantially 45 degrees with respect to each side of the hollow portion of the second waveguide 2. That is, the first waveguide 1 is substantially an octahedron in which two types of isosceles triangles inverted with respect to each other are alternately arranged, one type of isosceles triangles is being located between each side of the opening 1*a* and the corner portions of the second waveguide 2, and the other type of isosceles triangles is being located between the corner portions of the opening 1*a* and each side of the second waveguide 2. Moreover, in the present embodiment, the length L2 of one side of the hollow portion of the second waveguide 2 with respect to the length L1 of one side of the opening 1*a* is set to satisfy $L2=L1/\sqrt{2}$ so that each corner of the hollow portion of the second waveguide 2 lies on each side of the opening 1*a* of the first waveguide 1, that is, the hollow portion of the second waveguide 2 is inscribed in the opening 1*a* of the first waveguide 1, but, in contrast with the opening 1*a*, the size of the second waveguide 2 is not limited to the above and may be altered as necessary.

The dielectric plate 3 is a 90° phase shifter made of a dielectric material such as polyethylene, etc., and this dielectric plate 3 is fixed to be orthogonal to two parallel sides of the opening 1*a*. Therefore, the dielectric plate 3 is tilted by substantially 45° with respect to each inner wall surface of the second waveguide 2, and the dielectric plate 3 is set to be tilted by about 45° with respect to each of the probes 4 and 5.

When a circularly polarized wave enters waveguide 1 through the opening 1*a*, the dielectric plate 3 causes two linearly polarized waves having a 90° phase difference from each other to have the same phase. Also right-handed and left-handed circularly polarized waves are changed into linearly polarized waves which are receivers by the probes 4 and 5 which are orthogonal to the planes of polarization. The received signals are frequency converted to intermediate-frequency signals by a converter circuit (not illustrated) and are outputted, and thus a circularly polarized wave can be received. In that case, since the dielectric plate 3 is substantially orthogonal to two parallel sides of the opening 1*a*, the linearly polarized waves having a 90° phase difference from each other can be made to have the same phase, even if the entire length of the first waveguide 1 is shortened to make the dielectric plate 3 shorter, because the component of the polarized waves propagating in the dielectric plate 3 increases. On the other hand, since the dielectric plate 3 is tilted by substantially 45° with respect to each internal wall surface of the second waveguide 2, linearly polarized waves to which a circularly polarized wave was converted by the dielectric plate 3 can be reliably coupled to the probes 4 and 5. Therefore, even if the length of the dielectric plate 3 is shortened, the phase difference between orthogonal polarized waves can be increased, and, to that much, the total length of the first waveguide 1 can be shortened, and accordingly the circularly polarized wave generator can be made smaller.

According to the circularly polarized wave generator of the first embodiment described above, the dielectric plate 3 arranged inside the first waveguide 1 is tilted by substantially 45° with respect to the flat surfaces of the second waveguide 2. Since this dielectric plate 3 is substantially orthogonal to two parallel sides of the opening 1*a* of the first waveguide 1, even if the dielectric plate 3 is shortened, the phase difference between orthogonal polarized waves becomes large and the circularly polarized wave generator can be made smaller. Furthermore, since the size of the second waveguide 2 is set such that the corner portion of the neighboring inner wall surfaces of the second waveguide 2 is on the opening 1*a* of the first waveguide 1, that is, the second waveguide 2 is inscribed in the opening 1*a* of the first waveguide 1, for example, by rolling out and expanding part of a rectangular waveguide having the same cross-section as that of the second waveguide 2, a first waveguide 1 and a second waveguide 2 which are connected in the axial direction can be easily produced.

Figure 5:
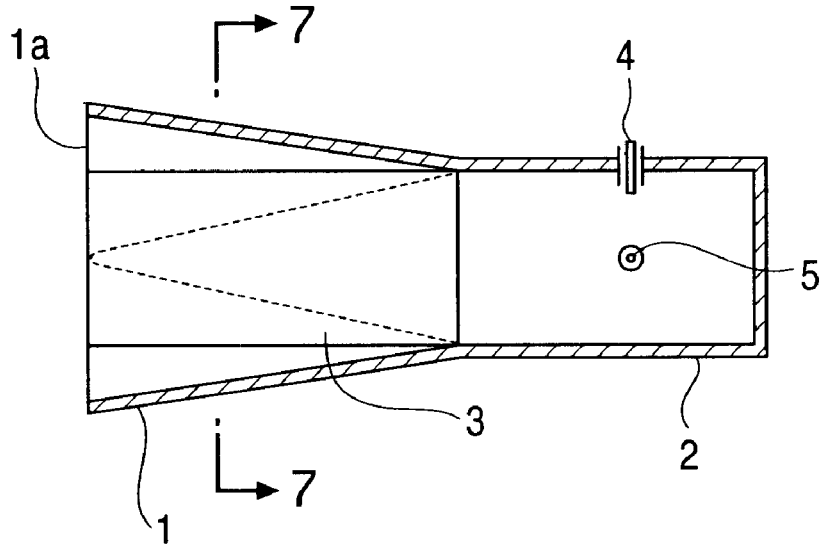
FIG. 5 shows the construction of a circularly polarized wave generator according to a second embodiment of the present invention.
Figure 6:
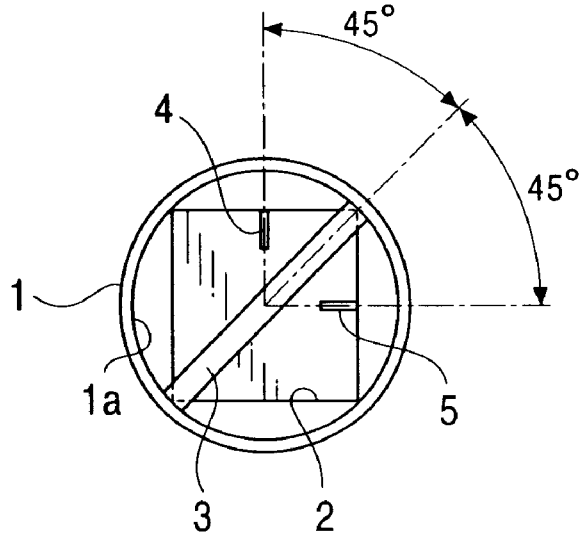
FIG. 6 is a left side view of the circularly polarized wave generator.
Figure 7:
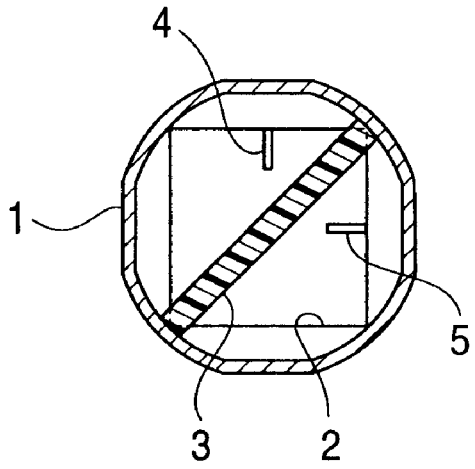
FIG. 7 is a sectional view taken on line 7—7 of FIG. 5.
Figure 8:
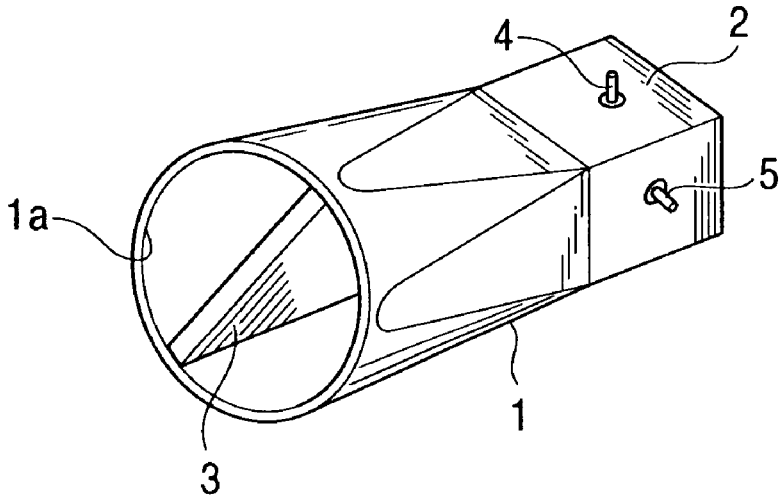
FIG. 8 is a perspective view of the circularly polarized wave generator.
Figure 9A:
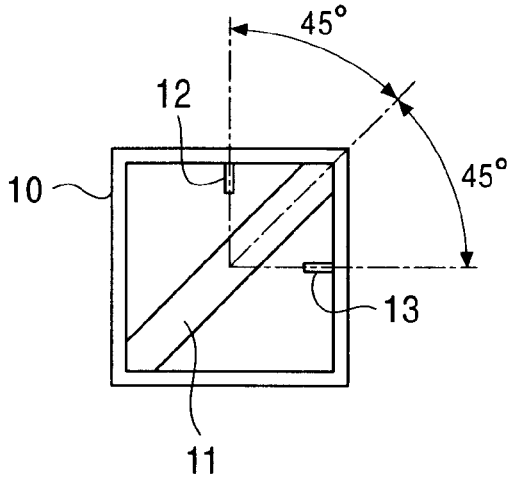
FIG. 9A PRIOR ART
FIGS. 9A and 9B show explanatory drawings of a conventional circularly polarized wave generator.
Figure 9B:
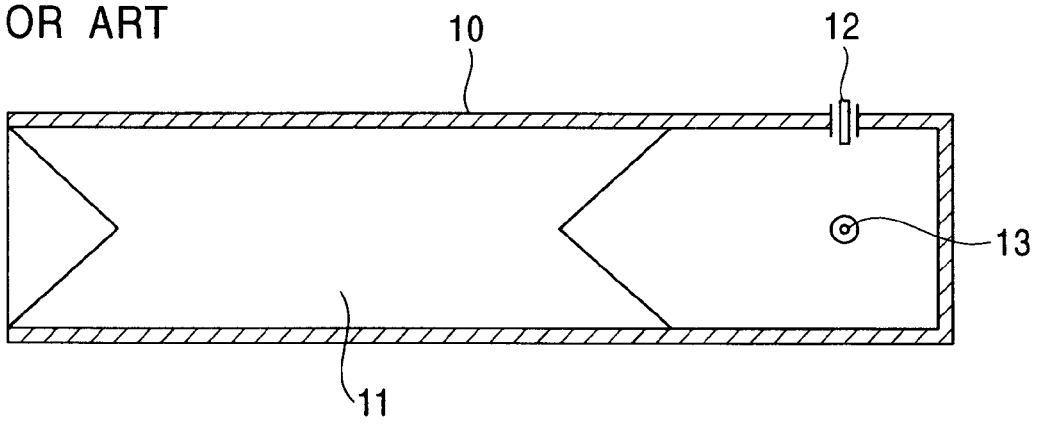
FIG. 9B PRIOR ART
Figure 10:
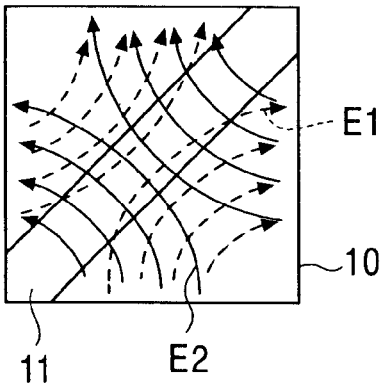
FIG. 10 PRIOR ART
FIG. 10 is an explanatory drawing of a dielectric plate in the conventional circularly polarized wave generator showing the electric field distribution.

FIG. 5 shows the construction of a circularly polarized wave generator according to a second embodiment of the present invention. FIG. 6 is a left side view of the circularly polarized wave generator, FIG. 7 is a sectional view taken on line VII—VII of FIG. 5, and FIG. 8 is a perspective view of the circularly polarized wave generator all of the circularly polarized wave generator shown in FIG. 5.

The present embodiment is different from the above described first embodiment in that the opening 1*a* of the first waveguide 1 is circular and, in keeping with that, the cross-section of the middle portion of the first waveguide 1 is substantially octagonal although the cross-section partially includes circular arcs, and the construction of the others is basically the same. That is, the circularly polarized wave generator according to the second embodiment includes a first waveguide 1, the inside of which is hollow, having a circular opening at one end thereof, a dielectric plate 3 provided inside the first waveguide 1, and a second waveguide 2 having a square cross-section coaxially connected to the other end of the first waveguide, and the dielectric plate 3 is tilted by substantially 45° with respect to each internal wall surface of the second waveguide 2. Furthermore, a pair of probes 4 and 5 are inserted inside the second waveguide 2 through the external wall surfaces, and these probes 4 and 5 are about one quarter wavelength away from the right closed surface of the second waveguide 2 shown in the drawing.

In the second embodiment constructed in this way, the dielectric plate 3 is arranged inside the first waveguide 1 having a circular opening 1*a* and this dielectric plate 3 is tilted by substantially 45° with respect to the flat surfaces of the second waveguide 2 connected to the first waveguide 1, and accordingly, even if the dielectric plate 3 is shortened, the phase difference between orthogonal polarized waves becomes large and, as a result, the circularly polarized wave generator can be made smaller. Furthermore, since the size of the second waveguide 2 is set such that the corner portion of the neighboring inner wall surfaces of the second waveguide 2 is on the opening 1*a* of the first waveguide 1, that is, the second waveguide 2 is inscribed in the opening 1*a* of the first waveguide 1, for example, by rolling out and expanding part of a waveguide having a square cross-section having the same cross-section as that of the second waveguide 2, a first waveguide 1 and a second waveguide 2 which are connected in the axial direction can be easily produced.

The present invention can be realized as described above and shows the following effect.

A waveguide is divided into a first waveguide and a second waveguide which are coaxially connected. A dielectric plate is arranged inside the first waveguide having a square or circular opening, and the dielectric plate is tilted by substantially 45° with respect to the inner wall surfaces of the second waveguide having a square cross-section. Even if the length of the dielectric plate is shortened, the phase difference between orthogonal polarized waves becomes large and, as a result, the circularly polarized wave generator can be made smaller.

What is claimed is:

1. A circularly polarized wave generator comprising:

a first waveguide having square openings at one end and the other end thereof, a flat dielectric plate composed of a dielectric material which is arranged inside the first waveguide, wherein the first wave guide has an octagonal shape in cross section at a position between one end and the other end, the lengths of the sides of the orthogonal shape changing continuously from the square shape at one end to the square shape at the other end in accordance with the position along the axial direction, the square shape at one end and the square shape at the other end being tilted with respect to each other by substantially 45° along the circumferential direction around the axis of the first waveguide, and wherein the dielectric plate is disposed to be substantially orthogonal to two parallel sides of the square shape at one end at the corner between two orthogonal sides of the square shape at the other end.

2. A circularly polarized wave generator as claimed in claim 1, further comprising:

a second waveguide having a square cross-section coaxially connected to the other end of the first waveguide, and a probe which projects inside the second waveguide and which is tilted by substantially 45° with respect to the dielectric plate.

3. A circularly polarized wave generator as claimed in claim 2, wherein the second waveguide is inscribed in the opening at one end of the first waveguide such that corner portions of neighboring inner wall surfaces of the second waveguide are on a boundary of the opening.

4. A circularly polarized wave generator comprising:

a first waveguide having a circular opening at one end thereof and a square opening at the other end thereof, a flat dielectric plate composed of a dielectric material which is arranged inside the first waveguide, wherein the first wave guide has a substantially octagonal shape including arcs in cross section at a position between one end and the other end, the lengths of the sides and the arcs of the substantially orthogonal shape changing continuously from the circular shape at one to the square shape at the other end in accordance with the position along the axial direction, and wherein the dielectric plate is disposed at the corner between two orthogonal sides of the square shape at the other end.

5. A circularly polarized wave generator as claimed in claim 4, further comprising:

a second waveguide having a square cross-section coaxially connected to the other end of the first waveguide, and a probe which projects inside the second waveguide and which is tilted by substantially 45° with respect to the dielectric plate.

6. A circularly polarized wave generator as claimed in claim 5, wherein the second waveguide is inscribed in the opening at one end of the first waveguide such that comer portions of neighboring inner wall surfaces of the second waveguide are on a boundary of the opening.

* * * * *